United States Patent [19]

Schreiber

[11] Patent Number: 4,941,715

[45] Date of Patent: Jul. 17, 1990

[54] VERTICAL FILING CABINET CONTAINING TELESCOPIC HANGING ASSEMBLIES WITH ADJUSTABLE SUPPORT MEANS CONNECTED THERETO

[75] Inventor: Adolf Schreiber, Red Lion, Pa.

[73] Assignee: H. Schreiber Company, Red Lion, Pa.

[21] Appl. No.: 301,059

[22] Filed: Jan. 25, 1989

[51] Int. Cl.[5] ..... A47B 63/02

[52] U.S. Cl. ..... 312/184; 312/185

[58] Field of Search ..... 312/184, 185, 188, 138 A, 312/136; 248/293

[56] References Cited

U.S. PATENT DOCUMENTS

| | | | |
|---|---|---|---|
| 1,335,415 | 3/1920 | Adams | 312/184 |
| 2,205,903 | 6/1940 | Möbus | 312/184 |
| 2,711,941 | 6/1955 | Möbus | 312/184 |
| 3,704,051 | 11/1972 | Köhler | 312/184 |

*Primary Examiner*—Kenneth J. Dorner
*Assistant Examiner*—Brian K. Green
*Attorney, Agent, or Firm*—Watson, Cole, Grindle & Watson

[57] ABSTRACT

Adjustment screws are threadingly engaged in the underside of a telescopic hanging assembly of a vertical filing cabinet to be respectively supported by the rear wall and the door of the cabinet when the door is opened to provide additional support for the telescopic hanging assembly.

7 Claims, 1 Drawing Sheet

VERTICAL FILING CABINET CONTAINING TELESCOPIC HANGING ASSEMBLIES WITH ADJUSTABLE SUPPORT MEANS CONNECTED THERETO

BACKGROUND OF THE INVENTION

1. Field of the Invention

The present invention relates to vertical filing cabinets which contain telescopic hanging assemblies mounted therein for supporting objects such as drawings and plans.

2. The Prior Art

Vertical filing cabinets which contain telescopic hanging assemblies for suspending drawings, plans, etc., are well known. See, for example, U.S. Pat. Nos. 2,205,903 and 2,711,941. It is also known to provide supports for the ends of the telescopic hanging asssemblies by mounting turnable discs on the rear wall and the door of the cabinet beneath the associated ends of the telescopic hanging assembly, each disc having a plurality of depressions in its periphery which are at varying radial distances from the turning axis of the disc. Appropriate manual rotation of each turnable disc determines which depression the telescopic hanging assembly will swing into for support when the door of the cabinet is opened.

It is an object of the present invention to provide a vertical filing cabinet that utilizes telescopic hanging assemblies and which includes an adjustable support means that can be attached to the telescopic hanging assembly itself, thus simplifying construction of the cabinet, and which will allow for extremely precise adjustment in the manner in which it supports the ends of the telescopic hanging assembly when the door of the cabinet is opened.

SUMMARY OF THE INVENTION

According to the present invention, a vertical filing cabinet which includes at least one telescopic hanging assembly that extends between the rear wall and the door of the cabinet and on which objects can be suspended within the cabinet also includes adjustable support means connected to the telescopic hanging assembly so as to be supported by the rear wall and the door of the cabinet when the door is opened to the desired degree, thereby providing additional support for the telescopic hanging assembly when the door is opened. The adjustable support means is preferably in the form of screws threadingly engaged in a lower side of the telescopic hanging assembly adjacent the rear wall and the door of the cabinet so as to be respectively supported by the rear wall and the door when the door is opened to a desired degree.

A further understanding of the invention will be achieved by reference to the accompanying drawings, taken in conjunction with the following discussion.

DETAILED DESCRIPTION OF THE PREFERRED EMBODIMENT

Figure 1:
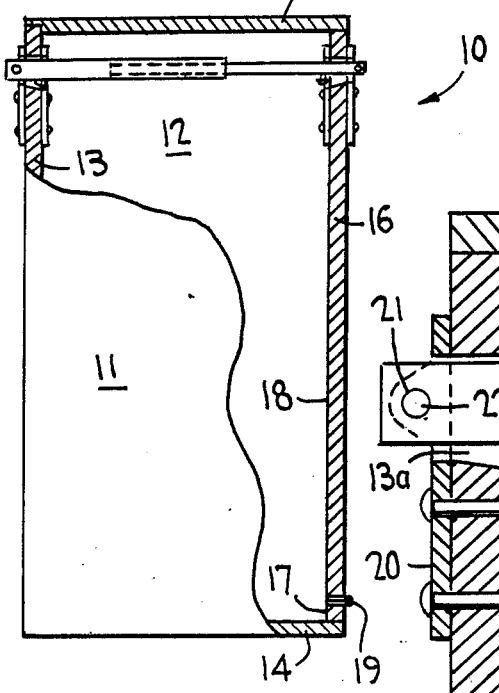
FIG. 1 shows a partially broken away side view of a vertical filing cabinet constructed according to the present invention, FIG. 2 a top portion of the vertical filing cabinet of FIG. 1 on an enlarged scale, and FIG. 3 a cross-sectional side view of the vertical filing cabinet of FIG. 1 when the upper portion of the front wall thereof, functioning as a door, is pivoted relative to the lower portion of the front wall to provide access to the interior of the cabinet.
Figure 2:
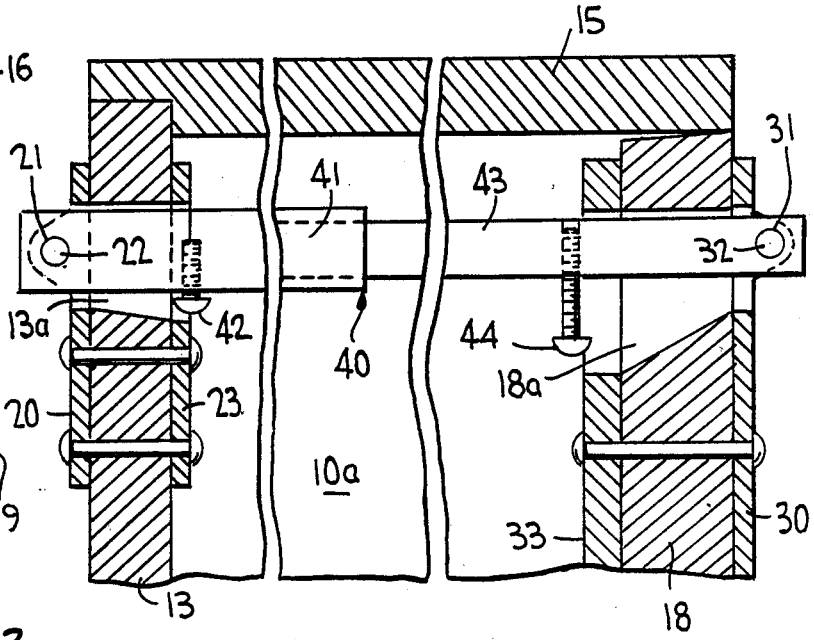
Figure 3:
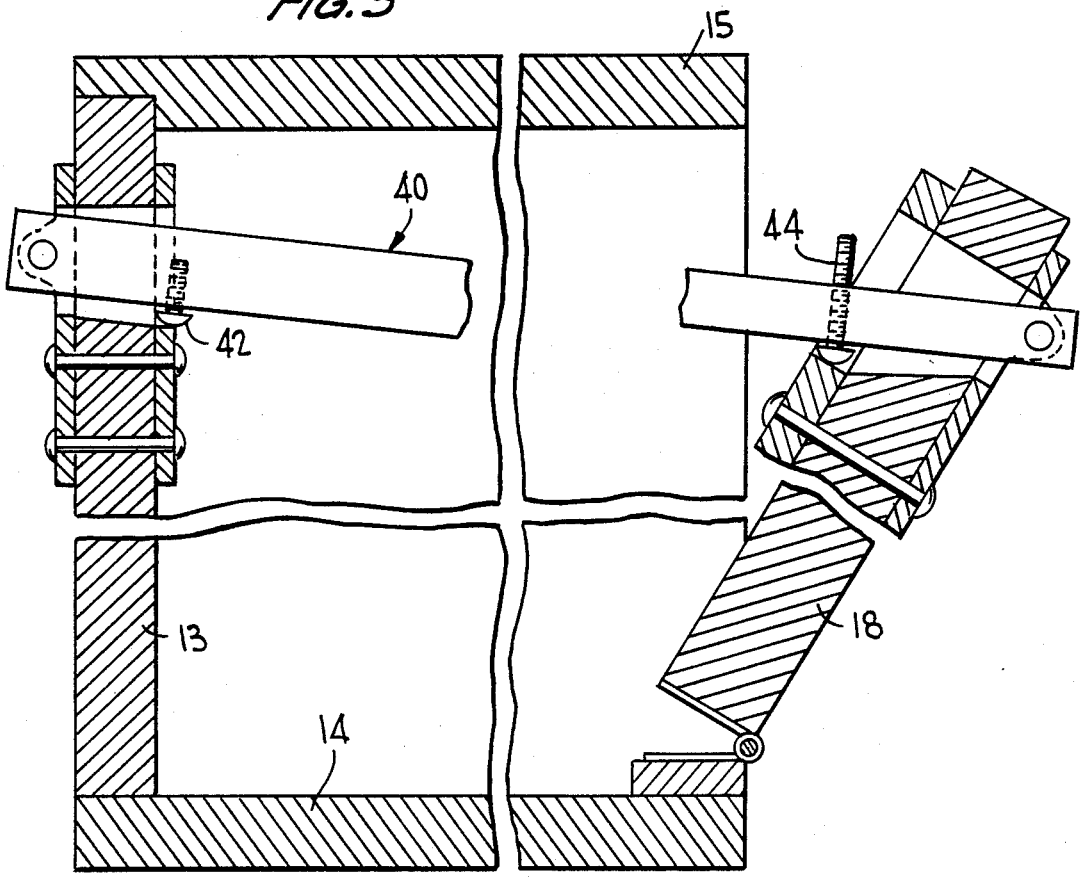

A vertical filing cabinet constructed according to a preferred embodiment of the present invention is shown in FIGS. 1–3 and is generally identified by reference numeral 10. It includes left and right side walls 11 and 12, a rear wall 13, a bottom 14, a top 15 and a front wall 16. The front wall includes a base portion 17 and an upper portion 18, the upper portion being connected to the base Portion by a hinge 19 whose pivot axis is horizontal (the term "horizontal" is used on the assumption that the bottom 14 of the cabinet is positioned on a horizontal support surface), thus enabling the upper portion 18 to function as a door when pivoted relative to the base portion as shown in FIG. 3. The upper portion 18 of the front wall 16 will hereinafter be referred to as the door 18.

The rear wall 13 includes a horizontal opening **13*a* near the top 15, the lower periphery of which flares downwardly in the direction of the interior 10*a* of the cabinet. Fixedly mounted to the rear wall 13 are outer and inner plates 20 and 23 which respectively have openings therein that are in register with the opening 13*a* and are shaped to conform to the shape of the opening 13*a* at the respective outer and inner surfaces of the rear wall. The outer plate 20 mounts brackets 21 that support a horizontal pin 22**.

The door 18 includes a horizontal opening **18*a* which is in register with the opening 13*a* when the door is vertically positioned (closed). The lower periphery of the opening 18*a* flares downwardly in the direction of the interior 10*a* of the cabinet. Fixedly mounted to the door 18 are outer and inner plates 30 and 33 which respectively have openings that are in register with the opening 18*a* and are shaped to conform to the shape of the opening 18*a* at the respective outer and inner surfaces of the door 18. The outer plate 30 mounts brackets 31 that support a horizontal pin 32**.

The vertical filing cabinet is also shown to include a telescopic hanging assembly 40 for supporting objects such as drawings, plans, etc., which are to be suspended within the cabinet. The support assembly 40 includes a rear tube 41 which is pivotably mounted on the horizontal pin 22 and extends through the opening **13*a* and into the interior of the cabinet, and a front rod 43 which is pivotally mounted on the horizontal pin 32 and extends through the opening 18*a* and into the interior of the cabinet. The front rod 43 fits within the rear tube 41 and is slidable with respect thereto to allow the door to be pivoted about the hinge 19**.

Connected to the telescopic hanging assembly is an adjustable support means in the form of a rear adjustment screw 42 and a front adjustment screw 44. The rear adjustment screw 42 is threadingly engaged in the underside of the rear tube 41 at a point which generally corresponds with the opening in the inner plate 23, such that when the door 18 is opened by being pivoted about the hinge 19, the head of the rear adjustment screw will abut the inner plate 23. The front adjustment screw 44 is threadingly engaged in the underside of the front rod 43 at a point which is located slightly inwardly of the opening in the inner plate 33, such that when the door 18 is opened by being pivoted about the hinge 19, the head of the front adjustment screw will contact the inner plate 33. With the door 18 pivoted about hinge 19 to the desired degree, the rear adjustment screw 42 and the front adjustment screw 44 can be manually rotated so that their heads will abut the inner plates 22 and 33, respectively, to provide support for the respective rear tube and front rod, and thus the telescopic hanging assembly as a whole, whenever the door is therafter opened to the same degree.

Although a preferred embodiment of the invention has been shown and described, obvious modifications therein can be made therein and still fall within the scope of the following claims.

I claim:

1. A vertical filing cabinet which comprises left and right side walls, a rear wall, a bottom, a top and a front wall, said front wall including a door which can pivot about a horizontal axis, a telescopic hanging assembly which extends between said rear wall and said door to support objects to be suspended within the interior of said cabinet, said telescopic hanging assembly including a first end that is pivotally supported by said door and a second end that is pivotally supported by said rear wall, and an adjustable support means connected to said telescopic hanging assembly to provide support to said telescopic hanging assembly whenever said door is opened to a desired degree, said adjustable support means having a first portion movably located within said telescopic hanging assembly and a second portion that is located exteriorly of said telescopic hanging assembly, said second portion having a head end that abuts one of said rear wall and said door when said door is opened to said desired degree.

2. A vertical filing cabinet according to claim 1, wherein said adjustable support means comprises screws threadingly engaged in said telescopic hanging assembly which will respectively abut said door and said rear wall when said door is opened to a desired degree.

3. A vertical cabinet according to claim 1, wherein said door includes an opening therein, wherein a first outer plate having an opening therein and a first inner plate having an opening therein are respectively mounted on outer and inner surfaces of said door such that said openings in said first outer and inner plates are aligned with said opening in said door, wherein said first end of said telescopic hanging assembly is pivotally connected to said first outer plate and extends through said opening in said door into the interior of said cabinet, wherein said rear wall includes an opening therein, wherein a second outer plate having an opening therein and a second inner plate having an opening therein are respectively mounted on outer and inner surfaces of said rear wall such that said openings in said second outer and inner plates are aligned with said opening in said rear wall, and wherein said second end of said telescopic hanging assembly is pivotally connected to said second outer plate and extends through said opening in said rear wall into the interior of said cabinet.

4. A vertical filing cabinet according to claim 3, wherein said adjustable support means comprises screws threadingly engaged in said telescopic hanging assembly so as to respectively contact said first inner plate and said second inner plate when said door is opened to a desired degree.

5. A vertical filing cabinet according to claim 4, wherein a lower periphery of said opening in said door flares downwardly in the direction of the interior of said cabinet, and wherein the openings in said first outer and first inner plates are shaped to conform to the shape of said opening in said door at respective outer and inner surfaces of said door.

6. A vertical filing cabinet according to claim 5, wherein a lower periphery of said opening in said rear wall flares downwardly in the direction of the interior of said cabinet, and wherein the openings in said second outer and second inner plates are shaped to conform to the shape of said opening in said rear wall at respective outer and inner surfaces of said rear wall.

7. A vertical filing cabinet according to claim 6, wherein said telescopic hanging assembly comprises a rear tube which is pivotally connected to said second outer plate and a front rod which is pivotally connected to said first outer plate.

* * * * *